United States Patent [19]

Hofmann et al.

[11] 4,113,238

[45] Sep. 12, 1978

[54] DRUM MIXER

[75] Inventors: Franz Hofmann, Neuhausen; Franz Szatmari, Schaffhausen, both of Switzerland

[73] Assignee: Georg Fischer Aktiengesellschaft, Schaffhausen, Switzerland

[21] Appl. No.: 729,979

[22] Filed: Oct. 6, 1976

[30] Foreign Application Priority Data

Oct. 10, 1975 [CH] Switzerland ..... 13208/75

[51] Int. Cl.[2] ..... B28C 5/18; B01F 9/08

[52] U.S. Cl. ..... 366/56; 366/224; 366/233

[58] Field of Search ..... 259/3, 14, 16, 30, 33, 259/81 R, 84, 85, 88, 174 R, 177 R, 175, DIG. 40

[56] References Cited

U.S. PATENT DOCUMENTS

| | | | |
|---|---|---|---|
| 1,650,592 | 11/1927 | Bickel | 259/174 |
| 1,729,361 | 9/1929 | Royer | 259/DIG. 40 |
| 2,310,603 | 2/1943 | Taylor | 259/3 |
| 2,492,792 | 12/1949 | Ford | 259/177 R |
| 2,559,899 | 7/1951 | Puller | 259/88 X |
| 2,592,334 | 4/1952 | Reiffen | 259/84 |
| 3,933,341 | 1/1976 | Hudelmaier | 259/174 |

*Primary Examiner*—Herbert F. Ross

*Attorney, Agent, or Firm*—Toren, McGeady and Stanger

[57] ABSTRACT

Rotary mixing apparatus particularly suitable for treatment of foundry sand having a drum mounted for rotation about an axis which is horizontal, or at least approximately horizontal, operates to treat bulk material such as foundry sand which is placed within the rotating drum. Stationary deflection apparatus is arranged within the drum in the upper range thereof and a rotating impact rotor is mounted within the drum so that as the drum rotates and the material contained therein is propelled into the upper region of the drum it is deflected by the deflection apparatus and formed into a downwardly falling jet which is directed at the rotating impact rotor.

10 Claims, 9 Drawing Figures

1
2
3
4
5
6
7
8
9
10
11
12
13
14
II

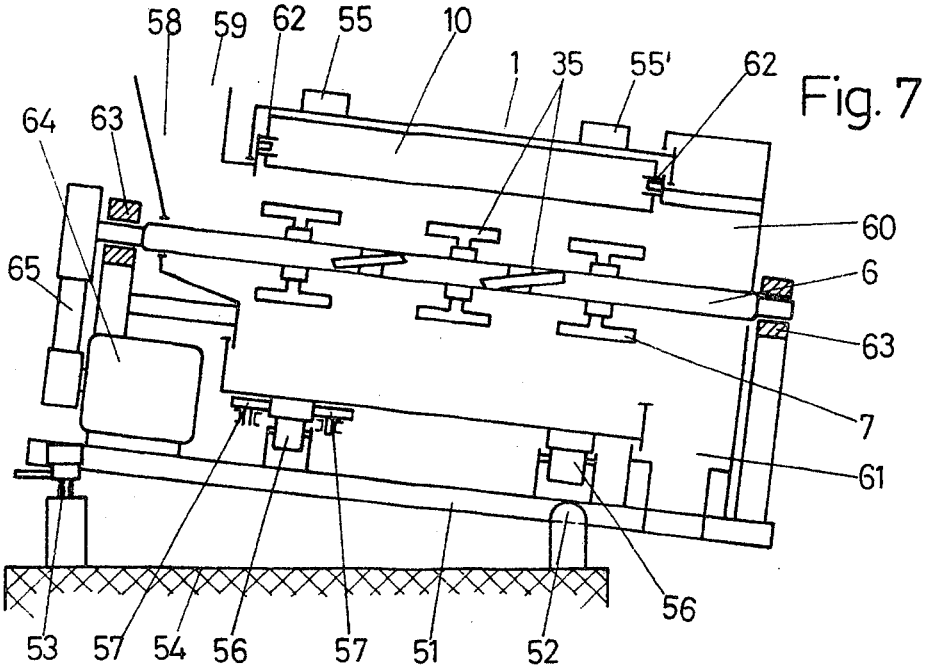
Fig. 7
Fig. 8
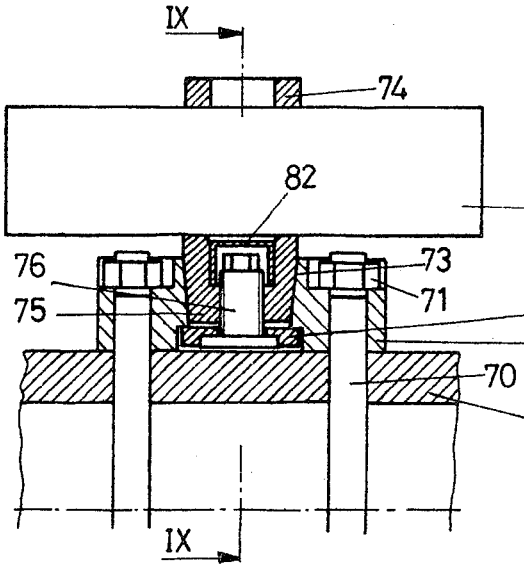
Fig. 9
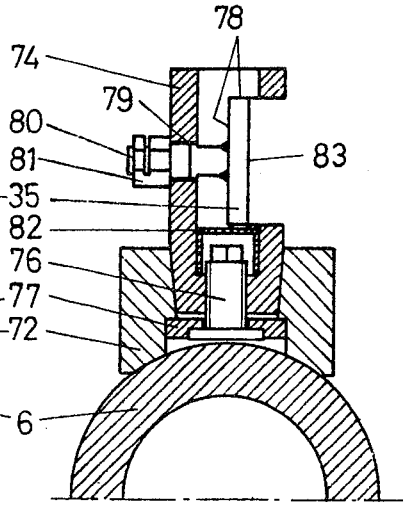

DRUM MIXER

BACKGROUND OF THE INVENTION

The present invention relates generally to apparatus for treating bulk materials such as foundry sand and more particularly to a drum mixer which comprises a drum rotating about a horizontal or substantially horizontal axis with at least one chamber being formed within the drum and with the drum being rotated at such a speed that the bulk material contained therein is carried from an accumulated mass in the lower region of the drum upwardly by centrifugal force into the upper region of the drum where it is stripped off from the inner wall of the drum by a fixed deflection device forming the bulk material into a downwardly falling jet.

From the prior art, particularly German patent application No. H 13.467, there is known a machine of the aforementioned type wherein a falling jet produced by a deflection device is sprayed with an aggregate, e.g. a liquid binder. The movement of the deflection device operates to prevent formation of a crust upon the latter, but it has been found to be not possible with this device to prevent the formation of lumps in the bulk material or to remove lumps formed therein. In such prior art devices it has been found that the distribution of the material by centrifugal force is virtually nonexistent or existent only to a minor extent so that it is not possible to admix secondary components.

A further mechanism or mixing machine known in the prior art, specifically DT-AS No. 2003201, involves a rotating container inclined relative to the horizontal plane carrying close to its bottom area a curved baffle plate which extends from the inner wall to the outer circumference of a discharge opening in the bottom of the rotating container, and at least one rotating tool engaging the material and surrounded by the latter.

Since a machine of this type does not produce a fine falling jet, it is not possible to introduce binders so that the grains will be uniformly enveloped by the latter. A stirring tool dipping into the sand will not act as a fan blower and therefore will have only a moderate lump-dispersing effect. Furthermore, high power consumption is required so that the temperature of the bulk material will be unnecessarily increased thereby resulting in harmful effects. A homogeneous distribution of the fine portions of old sand and of newly added materials, such as bentonite, coal dust, etc. is only possible to a limited extent since the bulk material is not brought into a loosened state in the form of a falling jet.

Accordingly, it is an object of the present invention to provide a drum mixer of the aforementioned type which will enable optimum and rapid preparation and treatment of foundry sands while avoiding the aforementioned inconveniences where the material to be prepared is highly permeable to gas without subsequent treatment.

SUMMARY OF THE INVENTION

The advantages of the present invention are basically achieved by arranging an impact rotor within the drum in the range of the entire falling jet of bulk material.

Thus, the overall apparatus of the present invention may be described as comprising a drum mixer adaptable for treatment of bulk materials, particularly foundry sand, with the drum being mounted for rotation about an axis which is at least approximately horizontal and with the drum defining therein an internal chamber or chambers within which the bulk material is treated. Stationary deflection means are arranged within the internal chamber in the upper range of the drum above the rotational axis, and the deflection means are mounted in a fixed position to enable the drum to rotate relative thereto. The rotating impact rotor is arranged generally centrally of the drum and is mounted to be rotatable therein. Rotation of the drum about its axis operates to propel bulk material located or accumulated in a mass at the bottom of the drum upwardly by centrifugal force against the deflection means. The deflection means is configured to deflect the bulk material away from the inner wall of the drum and to form the bulk material into a downwardly falling jet which is directed at the rotating impact rotor.

Due to this arrangement of the impact rotor, the free falling said is divided with great turbulence and the water in the sand will be distributed homogeneously in a very short time. Lumps will be split completely into individual grains and the prerequisites are achieved wherein the sand grains are enveloped individually with smooth binder films thereby yielding a gas-permeable material.

Due to the arrangement of the impact rotor in the path of the falling jet of the sand, energy is introduced as kinetic energy into the sand with good efficiency and without substantial heating while at the same time the falling jet is distributed over a larger circumferential region of the inner drum wall thereby substantially increasing the mixing effect of the drum mixer.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 7 is a schematic sectional elevation showing an embodiment of a drum mixer in accordance with the present invention having an inclined axis;

FIG. 8 is an axial sectional view showing on an enlarged scale the fastening mechanism for the impact rotor of the invention; and FIG. 9 is a sectional view taken along the line IX—IX of FIG. 8.

DESCRIPTION OF THE PREFERRED EMBODIMENTS

Figures 1, 2, 3:
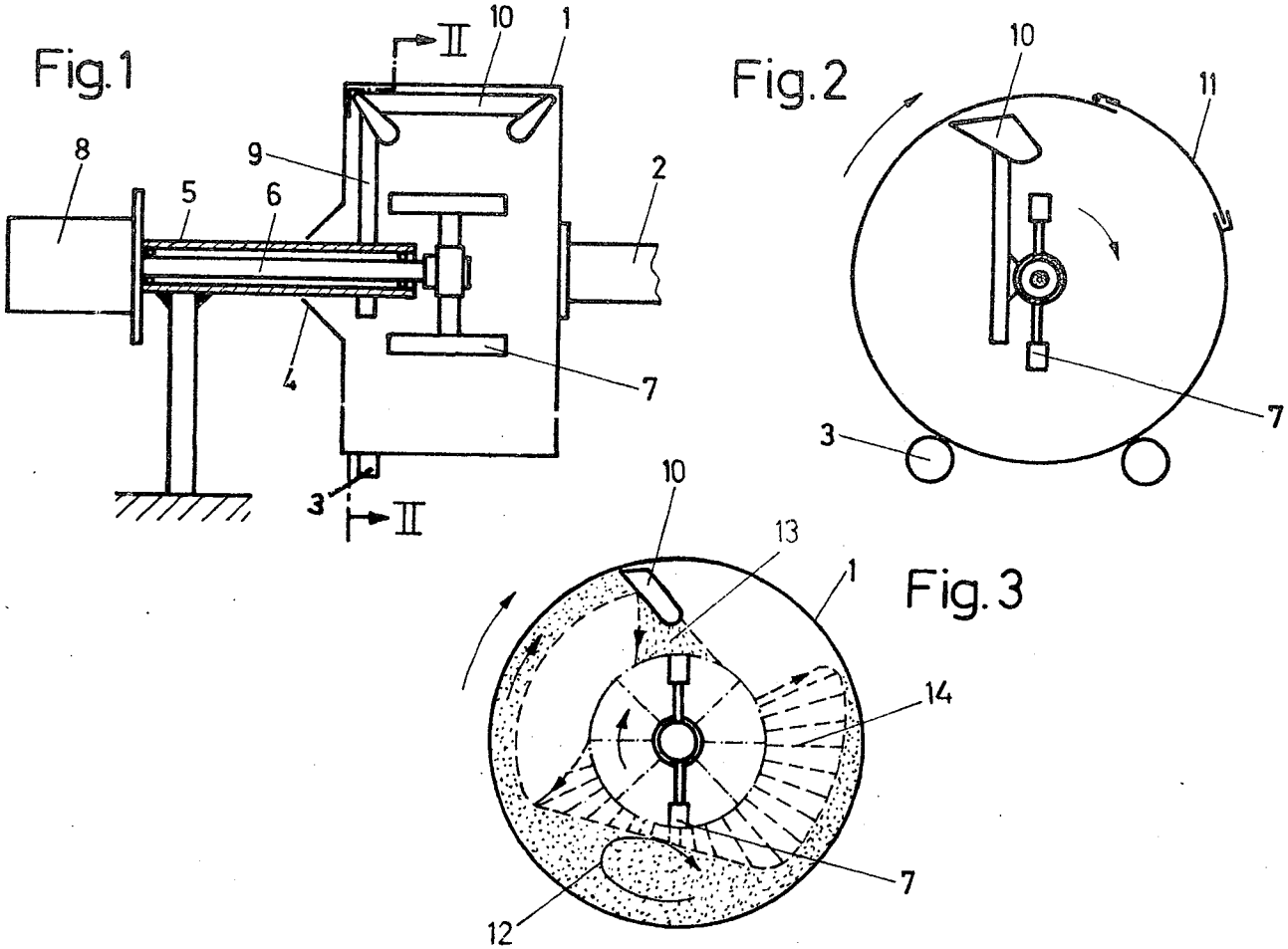
FIG. 1 is a sectional schematic elevation showing the mixer apparatus of the present invention in a simplified representation.
FIG. 2 is a schematic sectional view taken along the line II—II of FIG. 1.
FIG. 3 is a schematic representation showing the flow pattern of material during operation of the present invention to perform a mixing process.

Referring now to the drawings, wherein like reference numerals are used to refer to similar parts throughout the various views thereof, and referring more specifically to FIGS. 1 and 2, the apparatus of the present invention is shown as including a revolving drum 1 having an axis of rotation which is arranged to extend horizontally. Within the drum 1 there is located a stripper 10 and an impact rotor 7.

The arrangement of FIG. 1 comprises a drum mixer apparatus which is adapted for intermittent operation wherein the drum 1 bears upon rollers 3 and is mounted for rotation upon a shaft 2 driven by a driving means such as a motor (not shown). On the side of drum 1 opposite the shaft 2 there is arranged a bearing block 5 which protrudes through an opening 4 into the interior of the drum 1. Secured upon the bearing block 5 is a driving motor 8 which drives the impact rotor 7 through a shaft 6 rotatably mounted within bearing block 5. In the represented embodiment, the impact rotor 7 is arranged to be larger than the part of the bearing block 5 which protrudes into the drum 1. Naturally, an eccentric arrangement of the impact rotor 7 is also possible and it should be understood that the optimum positioning of the impact rotor 7 depends upon its diameter, the diameter of the drum 1 and the location of the deflection device 10.

Upon the part of the bearing block 5 which is arranged within the inner portion of the drum 1 there is provided a holder 9 having secured thereon the fixed deflection device 10. Thus, it will be seen that the device 10 is held stationary so that the drum 1 may rotate relative thereto. The drum 1 is provided on its circumference with a closeable opening 11 which may be used, depending upon the holding position of the drum, either as a feeding orifice with the holding position of the drum at the top, or as a discharge orifice when the holding position is at the bottom, for the material to be mixed.

A pair of opposite closeable openings may be provided so that the drum need not be rotated between the discharge and feeding steps of the material.

The mode of operation of the drum mixer apparatus depicted in FIGS. 1 and 2 involves initially charging of the drum 1 with the material to be mixed through the opening 11. The drum 1 should be filled to an optimum level but it should not be filled so far that the impact rotor 7 will act with the rotating drum upon the bulk material circuit formed on the drum wall. Subsequently, the drum is driven at a speed such that the bulk material will be carried or propelled by centrifugal force along the inner wall of the drum and at least a part of the bulk material will be carried upwardly within the drum to be stripped off by the deflection device 10 arranged in the upper region of the drum 1.

The flow pattern of the material is shown in FIG. 3 and the flow pattern depicted is such as will be achieved when the speed of the drum is preferably only so high that only a small portion of the bulk material is not carried along alternately by the inner drum wall and circulates only in the bottom part of the drum corresponding to the arrow 12, which increases the mixing effect.

As a result of the movement or rotation of the drum 1 and the upward propelling of the bulk material into the stationary deflection device 10, the bulk material will be formed into a downwardly falling jet 13 which is directed and deflected at the impact rotor which is driven at high speed in synchronism with the drum 1. As a result, the particles of the material are additionally accelerated with a scattering effect and change of direction.

The moistening of the bulk material is effected by spraying liquid either from nozzles arranged above the impact rotor into the falling jet 13 or from a nozzle in the center of the impact rotor into the centrifugal jets 14.

The degree of moistening of the bulk material may be indirectly measured over the current consumption of driving motors for the centrifugal separator and/or the drum, which can be utilized at the same time for regulating the addition of liquid.

Figure 5:
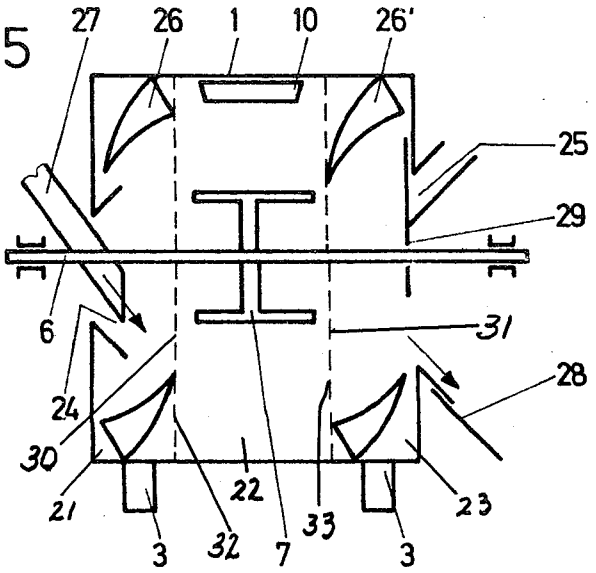
FIG. 5 shows a further embodiment of the present invention involving a variation from the embodiment represented in FIG. 4.
Figure 4:
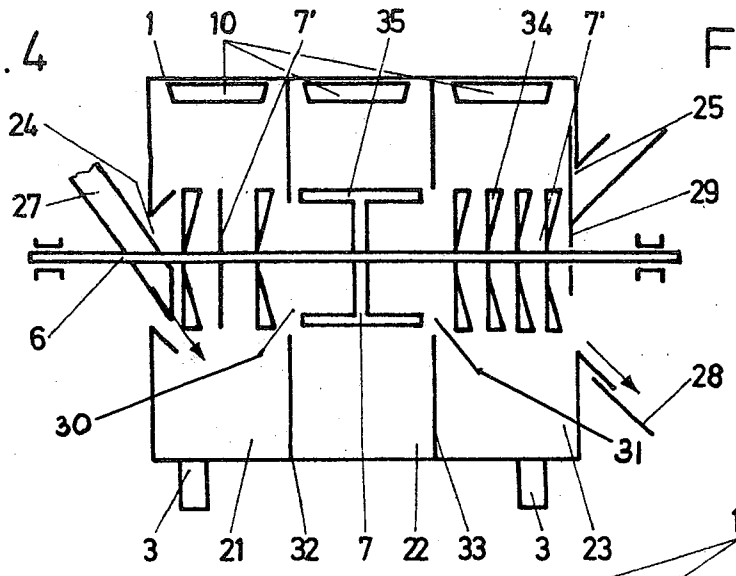
FIG. 4 is a schematic sectional elevation of another embodiment of the present invention operating with continuous charging.
Figure 6:
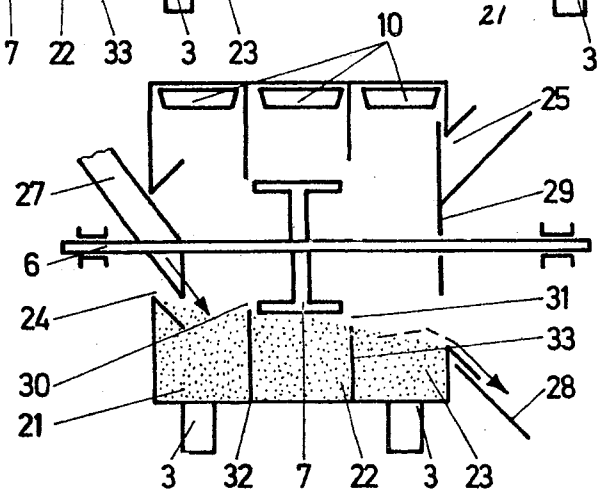
FIG. 6 shows a further variation of the embodiment depicted in FIG. 4.

FIGS. 4, 5 and 6 show variations or other embodiments of a drum mixer where continuous feeding and discharge of the bulk material may be performed. Here, the drum 1 is provided according to FIGS. 4, 5 and 6 at its end and on one side with an inlet 24 and on the other side with an outlet 25 traversed by the bilaterally mounted shaft 6 for driving the impact rotors 7,7'. Shaft 6 is driven by a motor (not shown) and the drum 1 is mounted on rollers 3 and may be driven, for example, by driven rollers. The outlet 25 is covered partially by a fixed shield 29. Laterally of the shaft 6 there is provided a feed pipe 27 for feeding the bulk material with the feed pipe extending through inlet 24 into the interior of the drum 1.

In the embodiment depicted in FIG. 4, the drum 1 is divided by partitions 32 and 33 into a charging chamber 21, a preparation chamber 22 and a discharge chamber 23. In each of these three chambers there is arranged a fixed deflection device 10 with a representation of the necessary mounting means having been omitted for the sake of clarity. Each of the three chambers of FIG. 4 have assigned thereto one of the impact rotors 7, 7' secured upon shaft 6. These rotors are so designed that the bulk material receives an additional axial motive component by rotation of the rotors so that the material is conveyed from the charging chamber 21 through the central opening 30 into the preparation chamber 22 and from there through the opening 31 into the discharge 23 and subsequently through outlet 25 to chute 28. The axial conveying action is achieved in comb-shaped impact rotors 7, 7' by the arrangement of inclined wings 34, and in I-shaped impact rotors 7 by inclination of rods 35 arranged on the circumference. Naturally, rotor designs with or without axial conveyer action are possible.

In the embodiment shown in FIG. 5, the drum 1 is likewise subdivided into three chambers 21, 22 and 23 but only preparation chamber 22 is equipped with an impact rotor 7 which does not effect axial conveyor action.

The axial conveyance of the bulk material is here effected by overflow from one chamber into the next adjacent chamber and from discharge chamber 23 through outlet 25 to chute 28. This may be achieved in that the opening 30 in partition 32 is larger than the inlet 24, with the opening 31 in partition 33 being larger than the opening 30, and with the outlet 25 being larger than the opening 31.

The resulting effect corresponding to a gradient may also be achieved, for example, by a drum with a slight inclination, where outlet 25 is lower than inlet 24.

In the embodiment shown in FIG. 5, the means for the axial conveyance of the bulk material are arranged on revolving drum 1 and they consist of blades 26, 26' which are arranged at both ends of the cylindrical inner wall of the drum 1. Between the shaped plates 26, 26' there is arranged the stationary deflection device 10 to which is assigned an impact rotor 7 secured on the shaft 6.

The bulk material may be introduced continuously through the inlet 24 into the drum 1 and it may then be transported immediately by the conveyor action of the blades or plates 26 into the preparation unit of drum 1 where it may be prepared as already described with reference to FIG. 3. When a certain amount of material has accumulated therein, an overflow action will develop whereby the material will move into the range of the blades 26' which convey the prepared bulk material through outlet 25 to chute 28.

An additional conveyor action in the axial direction in the preparation unit of this embodiment may be obtained by an axially conveying impact rotor 7 or a deflection device arranged in an inclined manner relative to the drum axis.

A further embodiment of a drum mixer (not shown) having axial conveyance may be obtained by a zig-zag arrangement of the rods 35 of the impact rotors 7 on both sides along shaft 6 in a drum 1 consisting of a single chamber. Due to these impact rotor rods 35, which are inclined alternately in two different directions, axial movement of the bulk material is produced alternately in both directions where the component in the conveying direction must be greater than the component opposite thereto. This may be achieved by a different angle of inclination or by a different length of the impact rotor rods 35 arranged in one direction relative to those in another direction.

In a symmetrical arrangement of the impact rotor rods in both directions, the larger motive component in the conveying direction may be obtained for example, by a drum axis which is inclined relative to the horizontal plane. Adjustability of the conveying action may be achieved preferably by a variable drum inclination.

FIG. 7 shows a drum mixer wherein the drum 1 is arranged on a mount base 51 which is adjustable about a fulcrum 52 by means of an elevating spindle 53 with varying inclination to the horizontal plane 54. Drum 1 is provided with supporting rings 55, 55' with which it bears upon the driven rollers 56 arranged on mount base 51. In the axial direction, drum 1 is held by guide rollers 57 arranged on both sides of the supporting ring 55. Arranged at the higher end of the drum 1 is a charging chamber 58 which is fixed relative to the revolving drum 1, and which includes an inlet 59, and on the opposite side there is provided a fixed discharge chamber 60 having an outlet 61. The deflection device 10 is adjustably mounted on a pin 62 so that the falling jet 13 (see FIG. 3) may be optimally adjusted.

Shaft 6 for the impact rotors 7 is mounted on both sides of the drum 1 in bearings 63 and it is driven by a motor 64 over a belt drive 65. The impact rotors 7 are staggered by 90°, with the impact rotor rods 35 being adjustable obliquely in the axial direction.

The bulk material is introduced through inlet 59 into the fixed charging chamber 58 and from there into the revolving drum 1 where it is mixed in the manner described with reference to FIG. 3. The axial conveyance is effected by the inclination of the drum and an additional mixing is effected in the axial direction by the impact rotor rods 35 which are alternately inclined in different directions. The prepared bulk material leaves the mixer through outlet 61 of the discharge chamber 60. The fastening and adjustment of the impact rotors 7 may be seen from FIGS. 8 and 9. Arranged on shaft 6 by means of a pair of screws 70 and nut 71 are fastening bases 72 which have a conical bore 73 whose axis extends perpendicularly to the axis of the shaft 6. The impact rotor holder 74 has a conical pin 75 and is adjustably mounted on fastening base 72 by means of finely threaded screws 76 bearing on a disk 77. In order to protect the thread, screw 76 is covered with a cap 82. The impact rotor holder 74 is provided with a recess 78 and a bore 79 into which there is inserted impact rotor rod 35 equipped with a threaded pin 80 secured by means of nut 81. The impact rotor rod 35, which is made of wear-resistant material, may thus be readily replaced. By loosening the screw 76, the impact rotor holder 74 may be turned in a conical bore 73 so that adjustment of the surface 83 of the impact rotor rod 35 may be ensured both in the same direction to the axis of the shaft 6 and in any angle relative to this axis.

This advantageous design of the drum mixer with the stepped conveyance of the bulk material ensures a particularly good mixing of the material in a continuous operation.

If the bulk material is cooled with air, which is considered to be particularly effective with regard to turbulence of the bulk material, the air is injected preferably through the inlet 24 so that an additional conveying action in the axial direction of the drum may be achieved.

The drum mixer of the present invention described herein is particularly characterized by the fact that it involves a small number of mixing tools, and permits, on the one hand, a simple and cost-saving design for both continuous and intermittent mixers, while on the other hand it allows a high degree of filling to be achieved.

The arrangement of the impact rotor in the path of the falling jet of the bulk material according to the invention ensures, together with the natural circulation of the material by the revolving drum, a thorough mixing with rapid homogenization of the water and uniform envelopment of the individual particles with the binder. At the same time, optimum transmission of the preparation energy to the material is achieved thereby ensuring an economical operation.

While specific embodiments of the invention have been shown and described in detail to illustrate the application of the inventive principles, it will be understood that the invention may be embodied otherwise without departing from such principles.

What is claimed is:

1. Mixer apparatus for treatment of bulk materials, particularly foundry sand, comprising: a drum mounted for rotation about an axis which extends at least approximately in a horizontal direction, said drum being arranged to define therein an upper drum interior region and a lower drum interior region located, respectively, above and below said axis, said lower drum interior region being arranged to have accumulated therein during rotation of said drum a portion of the bulk material being treated in said mixer apparatus; stationary deflection means arranged within said drum in said upper region thereof; rotating impact rotor means rotatably mounted within said drum at a location generally below said stationary deflection means to receive bulk material deflected therefrom and to enhance the mixing effect of said apparatus, said rotating impact rotor means including shaft means having a plurality of rigid rotor arms mounted thereon, said rotor arms being arranged to extend radially from said shaft means into said lower drum interior region a distance short of the lowermost point therein to permit in said lower drum region an accumulation of bulk material at a location out of the path of said rotating rotor arms; rotation of said drum about said axis operating to propel bulk material located therein upwardly by centrifugal force against said deflection means, said deflection means being structurally configured to deflect and direct said bulk material propelled thereagainst by rotation of said drum away from the inner wall of said drum into a downwardly falling jet directed at said rotating impact rotor means; and means unassociated with said impact rotor means and said deflection means for effecting axial conveyance of said bulk material through said drum.

2. Apparatus according to claim 1 wherein said impact rotor means is arranged to rotate about an axis which is parallel to the axis of rotation of said drum.

3. Apparatus according to claim 1 wherein said impact rotor means is arranged for rotation about an axis which is generally coincident with the axis of rotation of said drum.

4. Apparatus according to claim 1 wherein said impact rotor means is arranged to rotate in the same direction as the direction on which said drum rotates.

5. Apparatus according to claim 1 wherein said drum is of a generally cylindrical configuration having a pair of end faces on opposite sides thereof with feeding and discharging of the bulk material being effected between said end faces, said means for effecting axial conveyance of bulk material through said drum being provided on one end of said drum and essentially comprising blade-shaped plates.

6. Apparatus according to claim 1 wherein said drum is subdivided into a charging chamber, a preparation chamber and a discharge chamber, said means for axial conveyance of the bulk material comprising rotating impact rotors formed as part of said rotating impact rotor means and adapted to impart an axial direction of flow to said bulk material in the range of said charging chamber and said discharge chamber.

7. Apparatus according to claim 1 comprising a first partition having an opening therein and a second partition having an opening therein, said first and second partitions being arranged to subdivide said drum into a charging chamber, a preparation chamber and a discharge chamber, said drum further including an inlet opening into said charging chamber and an outlet opening from said discharge chamber, said opening in said first partition being larger than said inlet opening, said opening in said second partition being larger than said opening in said first partition, and said outlet opening being larger than said opening in said second partition.

8. Apparatus according to claim 1 wherein said shaft means includes a shaft which is generally coincident with the axis of rotation of said drum, and wherein said rotary impact rotor means include a plurality of impact rotors arranged along said shaft and including circumferential rods which are positioned in alternately inclined directions relative to the axis of said shaft.

9. Apparatus according to claim 8 wherein said impact rotor rods include surfaces which are adjustable with regard to the axial direction of said shaft.

10. Apparatus according to claim 1 wherein said stationary deflection means is adjustably mounted.

* * * * *